US006813889B2

(12) United States Patent
Inoue et al.

(10) Patent No.: US 6,813,889 B2
(45) Date of Patent: Nov. 9, 2004

(54) GAS TURBINE COMBUSTOR AND OPERATING METHOD THEREOF

(75) Inventors: Hiroshi Inoue, Hitachinaka (JP); Tomomi Koganezawa, Hitachi (JP); Nariyoshi Kobayashi, Hitachinaka (JP); Isao Takehara, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/083,360

(22) Filed: Feb. 27, 2002

(65) Prior Publication Data

US 2004/0011054 A1 Jan. 22, 2004

(30) Foreign Application Priority Data

Aug. 29, 2001 (JP) ..... 2001-259119

(51) Int. Cl.[7] ..... F02C 7/228
(52) U.S. Cl. ..... 60/737; 60/746
(58) Field of Search ..... 60/737, 740, 746, 60/773

(56) References Cited

U.S. PATENT DOCUMENTS 5,321,950 A * 6/1994 Shekleton et al. ..... 60/740
5,339,635 A * 8/1994 Iwai et al. ..... 60/746
RE34,962 E * 6/1995 Shekleton et al. ..... 60/746
5,651,252 A * 7/1997 Ansart et al. ..... 60/737
5,722,230 A * 3/1998 Cohen et al. ..... 60/737
5,899,074 A * 5/1999 Komatsu et al. ..... 60/737
6,389,815 B1 * 5/2002 Hura et al. ..... 60/746
6,481,209 B1 * 11/2002 Johnson et al. ..... 60/746

OTHER PUBLICATIONS

H. Inoue et al, "Research & Development of Methane–Oxygen Combustor for Carbon Dioxide Recovery Closed–Cycle Gas Turbine", 2001, 3C–05–CIM.

"Development of Combustor for LNG. Oxygen Firing", 29th Gas Turbine Regular Lecture Meeting—Collected Lecture Papers, 2001, pp. 113–118.

* cited by examiner

*Primary Examiner*—Michael Koczo
(74) *Attorney, Agent, or Firm*—Mattingly, Stanger & Malur, P.C.

(57) ABSTRACT

A gas turbine combustor has a combustion chamber into which fuel and air are supplied, wherein the fuel and the air are supplied into said combustion chamber as a plurality of coaxial jets.

7 Claims, 11 Drawing Sheets

GAS TURBINE COMBUSTOR AND OPERATING METHOD THEREOF

BACKGROUND OF THE INVENTION

1. Field of the Invention

The present invention relates to a gas turbine combustor and an operating method thereof.

2. Description of Prior Art

The present invention specifically relates to a low NOx type gas turbine combustor which emits low levels of nitrogen oxides. The prior art has been disclosed in Japanese Application Patent Laid-Open Publication No. Hei 05-172331.

In a gas turbine combustor, since the turndown ratio from startup to the rated load condition is large, a diffusion combustion system which directly injects fuel into a combustion chamber has been widely employed so as to ensure combustion stability in a wide area. Also, a premixed combustion system has been made available.

In said prior art technology, a diffusion combustion system has a problem of high level NOx. A premixed combustion system also has problems of combustion stability, such as flash back, and flame stabilization during the startup operation and partial loading operation. In actual operation, it is preferable to simultaneously solve those problems.

SUMMARY OF THE INVENTION

The main purpose of the present invention is to provide a gas turbine combustor having low level NOx emission and good combustion stability and an operating method thereof.

The present invention provides a gas turbine combustor having a combustion chamber into which fuel and air are supplied, wherein the fuel and the air are supplied into said combustion chamber as a plurality of coaxial jets.

Further, a method of operating a gas turbine combustor according to the present invention is the method of operating a gas turbine combustor having a combustion chamber into which fuel and air are supplied, wherein the fuel and the air are supplied into said combustion chamber as a plurality of coaxial jets.

BRIEF DESCRIPTION OF THE DRAWINGS

FIG. 4(*b*) is a side view of FIG. 4(*a*).

FIG. 5(*b*) is a side view of FIG. 5(*a*).

FIG. 6(*b*) is a side view of FIG. 6(*a*).

FIG. 7(*b*) is a side view of FIG. 7(*a*).

FIG. 8(*b*) is a side view of FIG. 8(*a*).

FIG. 9(*b*) is a side view of FIG. 9(*a*).

DESCRIPTION OF THE PREFERRED EMBODIMENTS

First, two kinds of combustion systems for a gas turbine combustor will be described.

Figure 2:
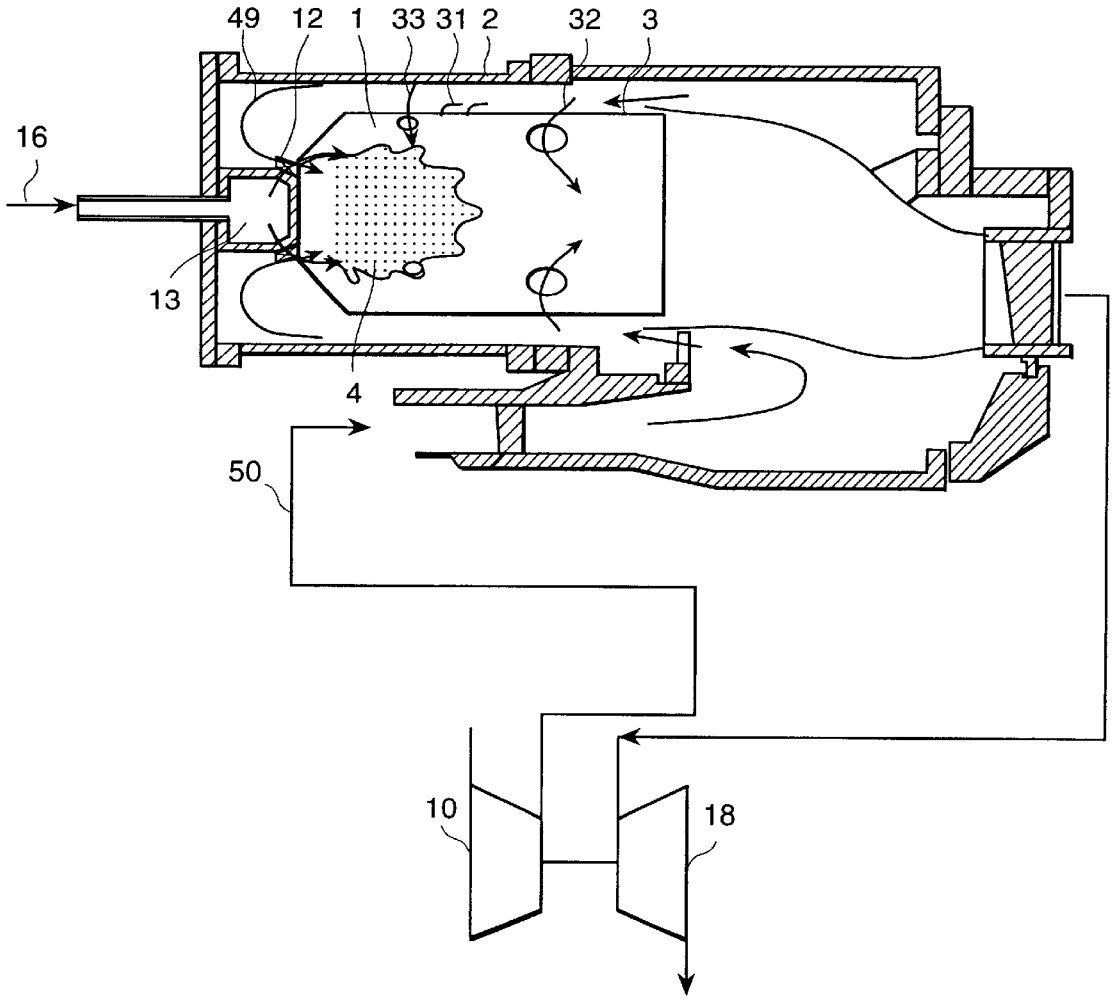
FIG. 2 is a sectional view, for explanation, of a diffusion combustion system.

(1) In a diffusion combustion system, as shown in FIG. 2, fuel is injected outward in the vicinity of the outlet of an air swirler arranged at a combustor head portion so as to intersect with a swirling air flow, generating a circulating flow on the central axis, thereby stabilizing a diffusion flame.

In FIG. 2, air 50 sent from a compressor 10 passes between an outer casing 2 and a combustor liner 3, and a portion of the air flows into a combustion chamber 1 as diluting air 32 which promotes mixture of cooling air 31 and combustion gas in the combustor liner, and another portion of the air flows into the combustion chamber 1 through the air swirler 12 as head portion swirling air 49. Gaseous fuel 16 is injected outward from a diffusion fuel nozzle 13 into the combustion chamber 1 so as to intersect with the swirling air flow, and forms a stable diffusion flame 4 together with the head portion swirling air 49 and primary combustion air 33. Generated high-temperature combustion gas flows into a turbine 18, performs its work, and then is exhausted.

The diffusion combustion system shown herein has high combustion stability, while a flame is formed in a area in which fuel and oxygen reach the stoichiometry, causing the flame temperature to rise close to the adiabatic flame temperature, Since the rate of nitrogen oxide formation exponentially increases as the flame temperature rises, diffusion combustion generally emits high levels of nitrogen oxides, which is not desirable from the aspect of air-pollution control.

Figure 3:
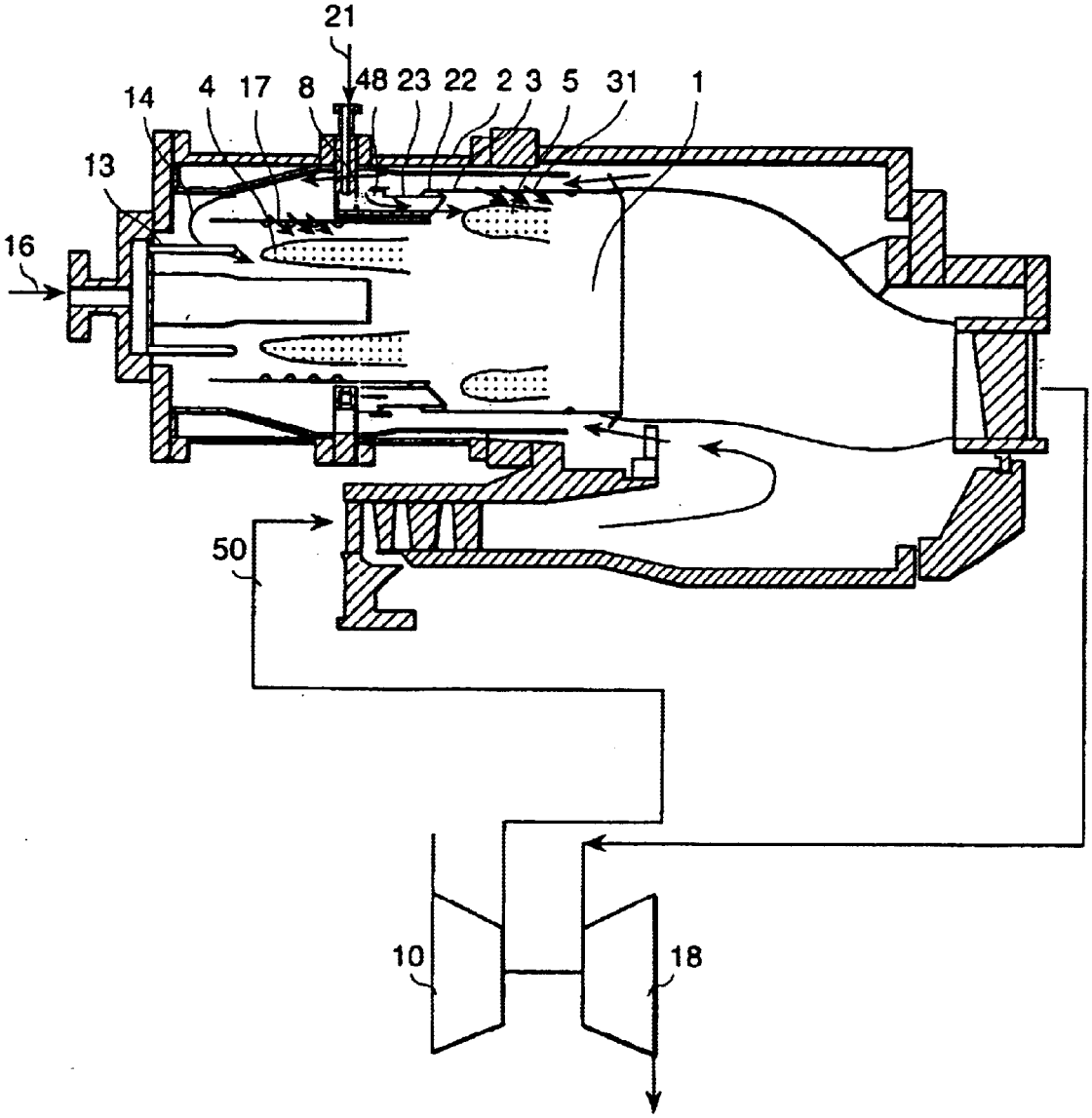
FIG. 3 is a sectional view, for explanation, of a premixed combustion system.

(2) On the other hand, the premixed combustion system is used to lower the level of NOx. FIG. 3 shows an example wherein the central portion employs diffusion combustion having good combustion stability and the outer-periphery side employs premixed combustion having low NOx emission to lower the level of NOx. In FIG. 3, air 50 sent from a compressor 10 passes between an outer casing 2 and a combustor liner 3, and a portion of the air flows into a combustion chamber 1 as cooling air 31 for the combustor liner and combustion gas in the combustor liner, and another portion of the air flows into a premixing chamber 23 as premixed combustion air 48. Remaining air flows into the combustion chamber 1, flowing through a passage between the premixing-chamber passage and the combustor end plate and then through a combustion air hole 14 and a cooling air hole 17. Gaseous fuel 16 for diffusion combustion is injected into the combustion chamber 1 through a diffusion fuel nozzle 13 to form a stable diffusion flame 4. Premixing gaseous fuel 21 is injected into the annular premixing chamber 23 through a fuel nozzle B, being mixed with air to become a premixed air fuel mixture 22. This premixed air fuel mixture 22 flows into the combustion chamber 1 to form a premixed flame 5. Generated high-temperature combustion gas is sent to a turbine 18, performs its work, and then is exhausted.

However, if such a premixed combustion system is employed, included instable factors peculiar to premixed combustion may cause a flame to enter the premixing chamber and burn the structure, or cause what is called a flash back phenomenon to occur.

In an embodiment according to the present invention, a fuel jet passage and a combustion air flow passage are disposed on the same axis to form a coaxial jet in which the air flow envelops the fuel flow, and also disposed on the wall surface of the combustion chamber to form multihole coaxial jets being arranged such that a large number of coaxial jets can be dispersed. Further, this embodiment is arranged such that a part of or all of the coaxial jets can flow in with a proper swirling angle around the combustor axis. Furthermore, it is arranged such that the fuel supply system is partitioned into a plurality of sections so that fuel can be supplied to only a part of the system during the gas turbine startup operation and partial loading operation.

In the form of a coaxial jet in which the air flow envelopes the fuel, the fuel flows into the combustion chamber, mixes with an ambient coaxial air flow to become a premixed air fuel mixture having a proper stoichiometric mixture ratio, and then comes in contact with a high-temperature gas and starts to burn. Accordingly, low NOx combustion equivalent to lean premixed combustion is possible. At this time, the section which corresponds to a premixing tube of a conventional premixing combustor is extremely short, and the fuel concentration becomes almost zero in the vicinity of the wall surface, which keeps the potential of burnout caused by flash back very low.

Further, by providing an arrangement such that a part of or all of the coaxial jets flow in with a proper swirling angle around the combustor axis, in spite of the form of a coaxial jet flow, it is possible to simultaneously form a recirculating flow to stabilize the flame.

Furthermore, it is possible to ensure the combustion stability by supplying fuel to only a part of the system during the gas turbine startup operation and partial loading operation thereby causing the fuel to become locally overconcentrated and burning the fuel in the mechanism similar to the diffusion combustion which utilizes oxygen in the ambient air.

First Embodiment

Figure 1:
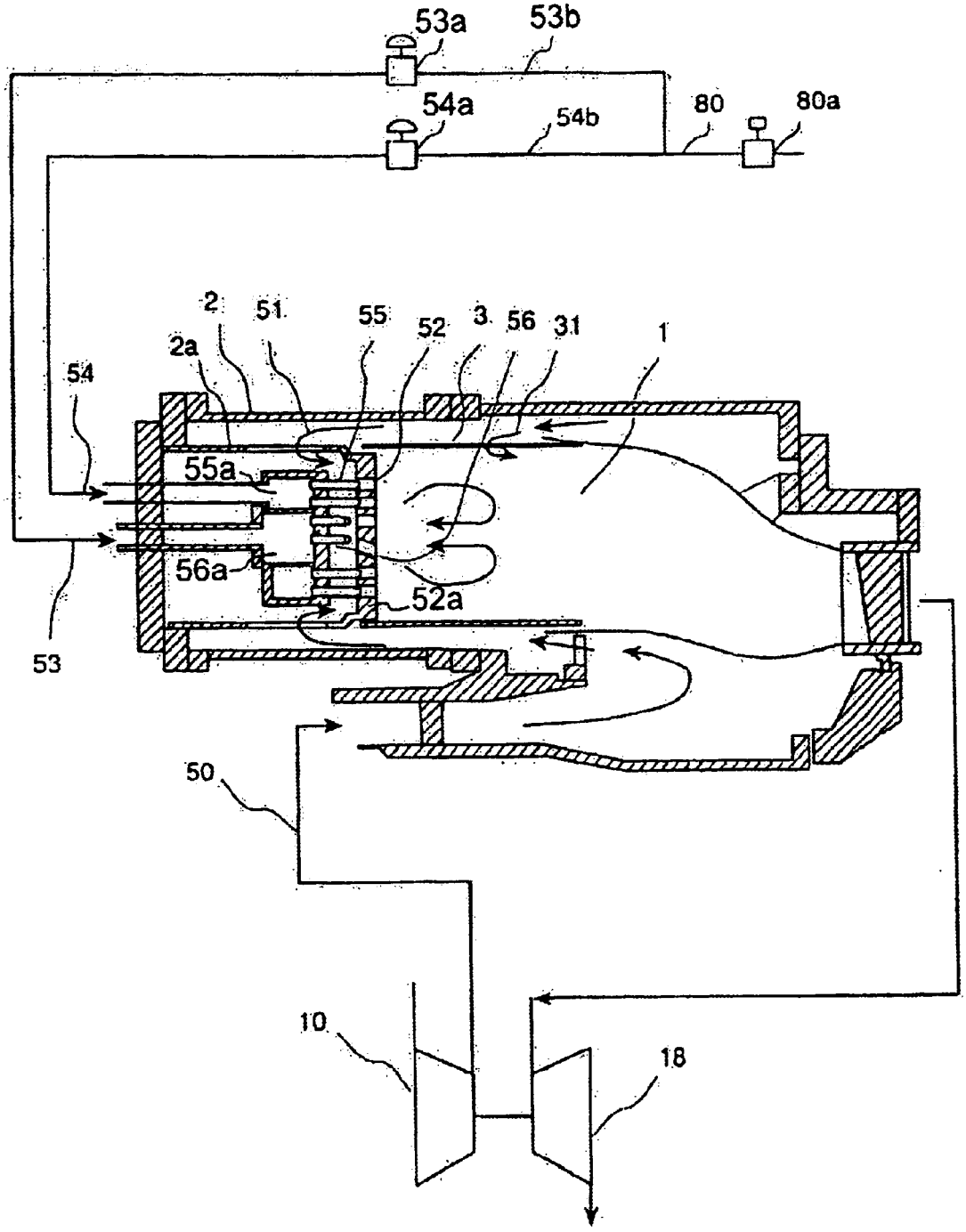
FIG. 1 is a diagram, for explanation, including a general cross-sectional view of a first embodiment according to the present invention.

A first embodiment according to the present invention will be described hereunder with reference to FIG. 1. In FIG. 1, air 50 sent from a compressor 10 passes between an outer casing 2 and a combustor liner 3. A portion of the air 50 is flowed into a combustion chamber 1 as cooling air 31 for the combustor liner 3. Further, remaining air 50 is flowed into the combustion chamber 1 as coaxial air 51 from the interior of inner cylinder 2*a* through holes 52 in an inner end 52*a* of the inner cylinder.

Fuel nozzles 55 and 56 are disposed coaxially or almost coaxially with combustion air holes 52. Fuel 53 and fuel 54 are injected into a combustion chamber 1 from fuel nozzles 55 and fuel nozzles 56 through supply paths 55*a*, 56*a* as jets almost coaxial with the combustion air thereby forming a stable flame. Generated high-temperature combustion gas is sent to a turbine 18, performs its work, and then is exhausted.

In this embodiment, with respect to fuel 53 and fuel 54, a fuel supply system 80 having a control valve 80*a* is partitioned. That is, the fuel supply system 80 herein is partitioned into a first fuel supply system 54*b* and a second fuel supply system 53*b*. The first fuel supply system 54*b* and the second fuel supply system 53*b* have individually-controllable control valves 53*a* and 54*a*, respectively. The control valves 53*a* and 54*a* are arranged such that each valve individually controls each fuel flow rate according to the gas turbine load. Herein, the control valve 53*a* can control the flow rate of a fuel nozzle group 56 in the central portion, and the control valve 54*a* can control the flow rate of a fuel nozzle group 55 which is a surrounding fuel nozzle group. This embodiment comprises a plurality of fuel nozzle groups: a fuel nozzle group in the central portion and a surrounding fuel nozzle group, fuel supply systems corresponding to respective fuel nozzle groups, and a control system which can individually control each fuel flow rate as mentioned above.

Figure 4:
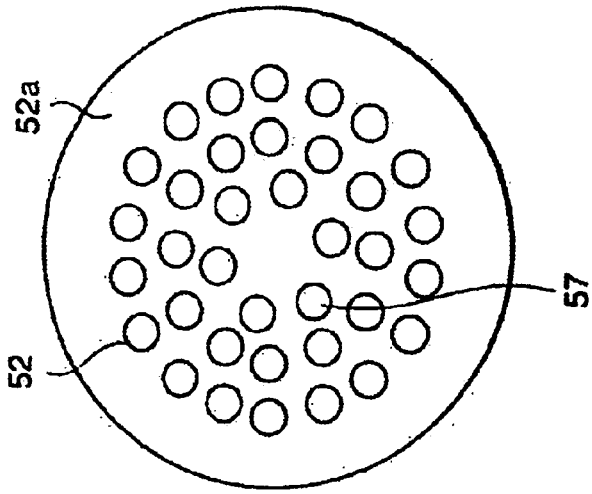
FIG. 4(*a*) is a sectional view of a nozzle portion of a first embodiment according to the present invention.
Figure 4:
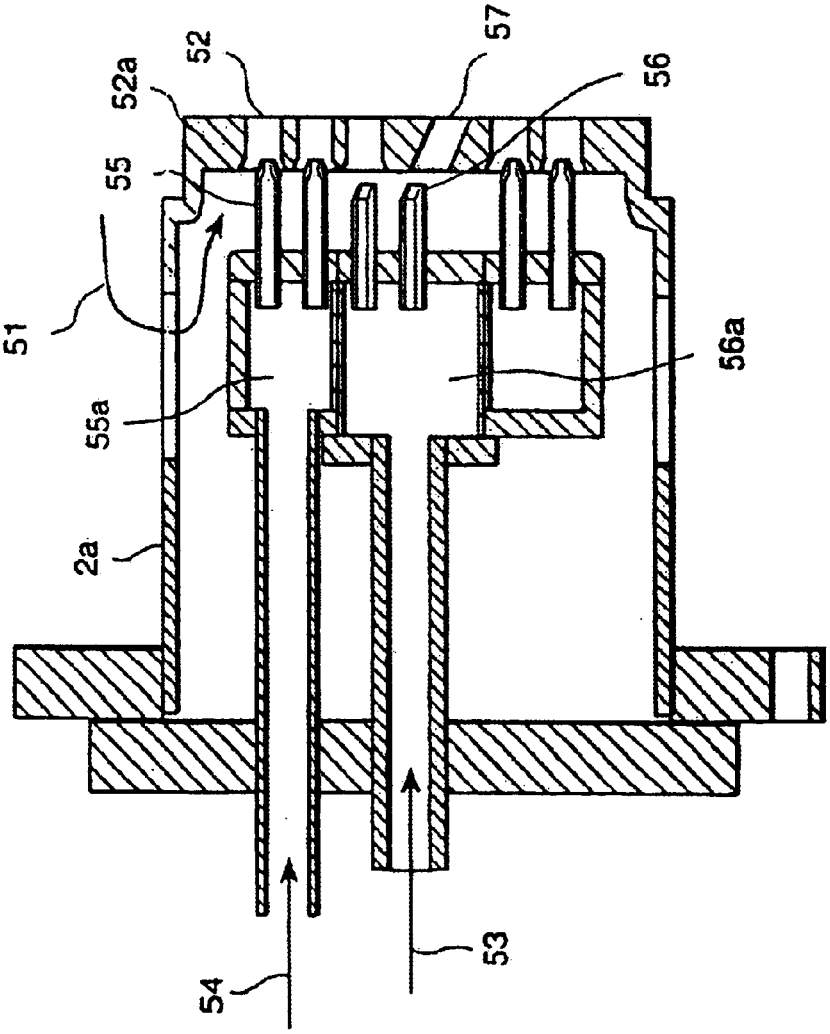

Next, the nozzle portion will be described in detail with reference to FIGS. 4(*a*) and 4(*b*). In this embodiment, the fuel nozzle body is divided into central fuel nozzles 56 and surrounding fuel nozzles 55. On the forward side of the fuel nozzles 55 and 56 in the direction of injection, corresponding air holes 52 and 57 are provided. A plurality of air holes 52 and 57 both having a small diameter are provided on the disciform member 52*a*. A plurality of air holes 52 and 57 are provided so as to correspond to a plurality of fuel nozzles 55 and 56.

Although the diameter of the air holes 52 and 57 is small, it is preferable to form the holes in such size that when fuel injected from the fuel nozzles 55 and 56 passes through the air holes 52 and 57, a fuel jet and an circular flow of the air enveloping the fuel jet can be formed accompanying the ambient air. For example, it is preferable for the diameter to be a little larger than the diameter of the jet injected from the fuel nozzles 55 and 56.

The air holes 52 and 57 are disposed to form coaxial jets together with the fuel nozzles 55 and 56, and a large number of coaxial jets in which an annular air flow envelopes a fuel jet are injected from the end face of the air holes 52 and 57. That is, the fuel holes of the fuel nozzles 55 and 56 are disposed coaxially or almost coaxially with the air holes 52 and 57, and the fuel jet is injected in the vicinity of the center of the inlet of the air holes 52 and 57, thereby causing the fuel jet and the surrounding annular air flow to become a coaxial jet.

Since fuel and air are arranged to form a large number of small diameter coaxial jets, the fuel and air can be mixed at a short distance. As a result, there is no mal distribution of fuel and high combustion efficiency can be maintained.

Further, since the arrangement of this embodiment promotes a partial mixture of fuel before the fuel is injected from the end face of an air hole, it can be expected that the fuel and air can be mixed at a much shorter distance. Furthermore, by adjusting the length of the air hole passage, it is possible to set the conditions from almost no mixture occurring in the passage to an almost complete premixed condition.

Moreover, in this embodiment, a proper swirling angle is given to the central fuel nozzles 56 and the central air holes 57 to provide swirl around the combustion chamber axis. By providing a swirling angle to the corresponding air holes 57 so as to give a swirling component around the combustion chamber axis, the stable recirculation area by swirl is formed in the air fuel mixture flow including central fuel, thereby stabilizing the flame.

Furthermore, this embodiment can be expected to be greatly effective for various load conditions for a gas turbine. Various load conditions for a gas turbine can be handled by adjusting a fuel flow rate using control valves 53*a* and 54*a* shown in FIG. 1.

That is, under the condition of a small gas turbine load, the fuel flow rate to the total air volume is small. In this case, by supplying central fuel 53 only, the fuel concentration level in the central area can be maintained to be higher than the level required for the stable flame being formed. Further, under the condition of a large gas turbine load, by supplying both central fuel 53 and surrounding fuel 54, lean low NOx combustion can be performed as a whole. Furthermore, under the condition of an intermediate load, operation similarly to diffusing combustion which uses ambient air for combustion is possible by setting the equivalence ratio of the central fuel 53 volume to the air volume flown from the air holes 57 at a value of over 1.

Thus, according to various gas turbine loads, it is possible to contribute to the flame stabilization and low NOx combustion.

As described above, by arranging a coaxial jet in which the air flow envelopes the fuel, the fuel flows into the combustion chamber, mixes with an ambient coaxial air flow to become a premixed air fuel mixture having a proper stoichiometric mixture ratio, and then comes in contact with a high-temperature gas and starts to burn. Accordingly, low NOx combustion equivalent to lean premixed combustion is possible. At this time, the section which corresponds to a premixing tube of a conventional premixing combustor is extremely short.

Furthermore, the fuel concentration becomes almost zero in the vicinity of the wall surface, which keeps the potential of burnout caused by flash back very low.

As described above, this embodiment can provide a gas turbine combustor having low level NOx emission and good combustion stability and an operating method thereof.

Second Embodiment

Figure 5:
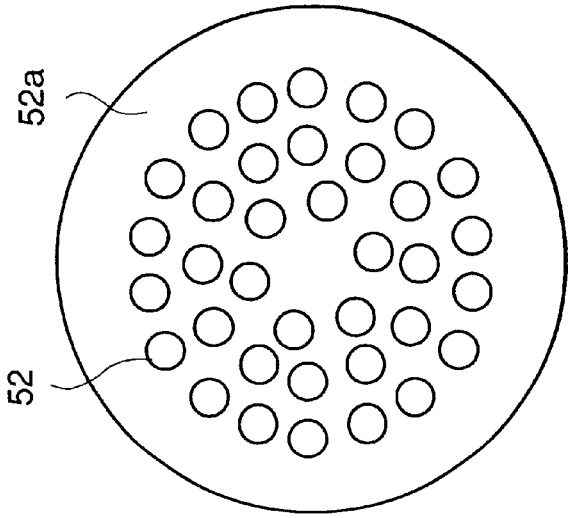
FIG. 5(*a*) is a sectional view, for detailed explanation, of a nozzle portion of a second embodiment according to the present invention.
Figure 5:
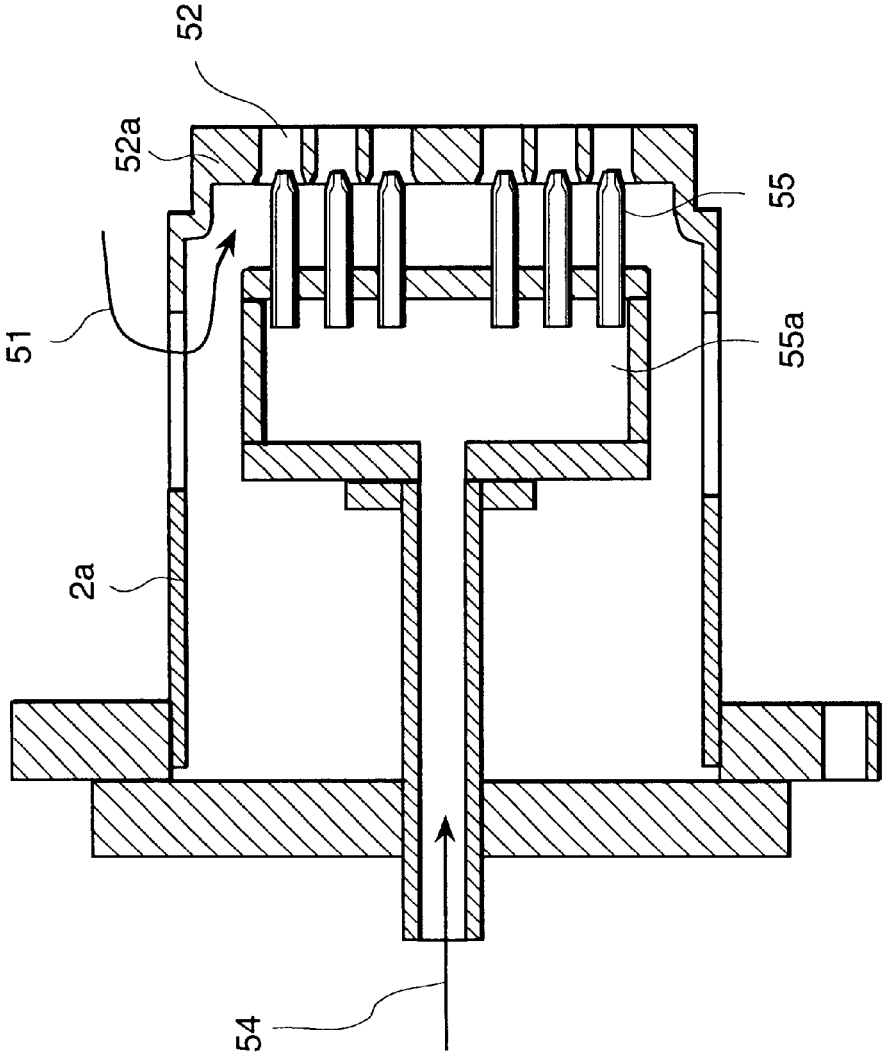

FIGS. 5(*a*) and 5(*b*) show the detail of the nozzle portion of a second embodiment. In this embodiment, there is a single fuel system which is not partitioned into a central portion and a surrounding portion. Further, a swirling angle is not given to the nozzles in the central portion and the combustion air holes. This embodiment allows the nozzle structure to be simplified in cases where the combustion stability does not matter much according to operational reason or the shape of the fuel.

Third Embodiment

Figure 6:
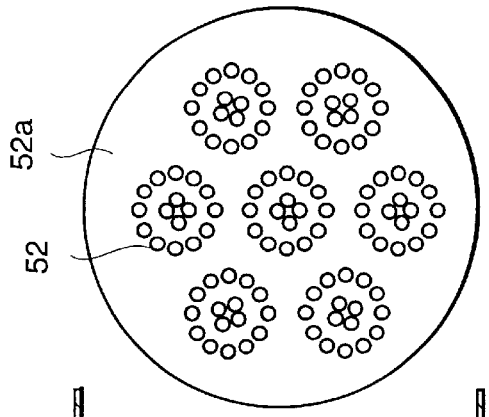
FIG. 6(*a*) is a sectional view, for detailed explanation, of a nozzle portion of a third embodiment according to the present invention.
Figure 6:
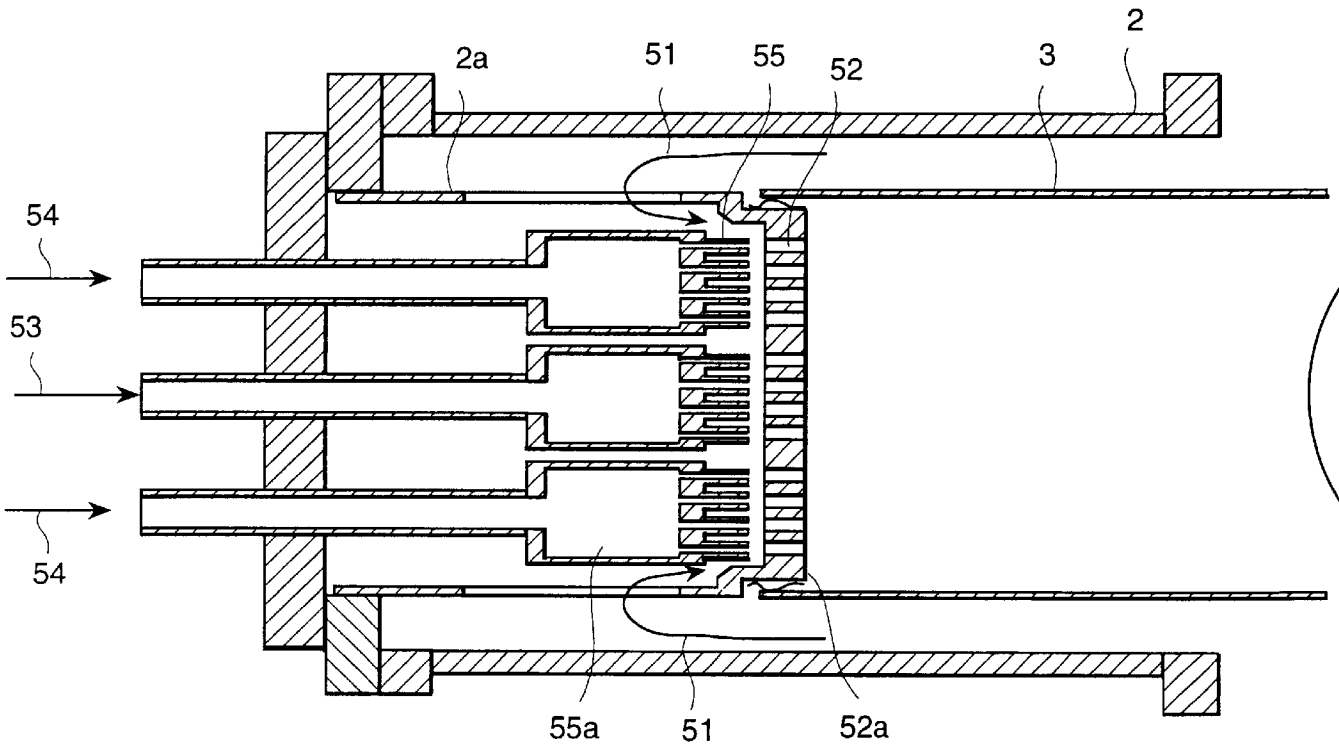

FIGS. 6(*a*) and 6(*b*) show a third embodiment. This embodiment is arranged such that a plurality of nozzles of a second embodiment shown in FIG. 5 are combined to form a single combustor. That is, a plurality of modules, each consisting of fuel nozzles and air holes, are combined to form a single combustor.

As described in a first embodiment, such an arrangement can provide a plurality of fuel systems so as to flexibly cope with changes of turbine loads and also can easily provide different capacity per one combustor by increasing or decreasing the number of nozzles.

Figure 7:
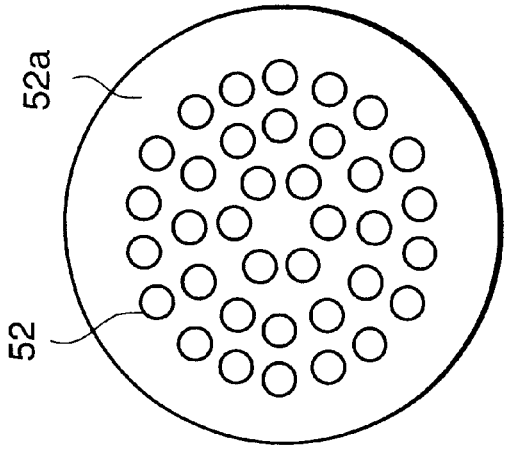
FIG. 7(*a*) is a sectional view, for detailed explanation, of a nozzle portion of a fourth embodiment according to the present invention.
Figure 7:
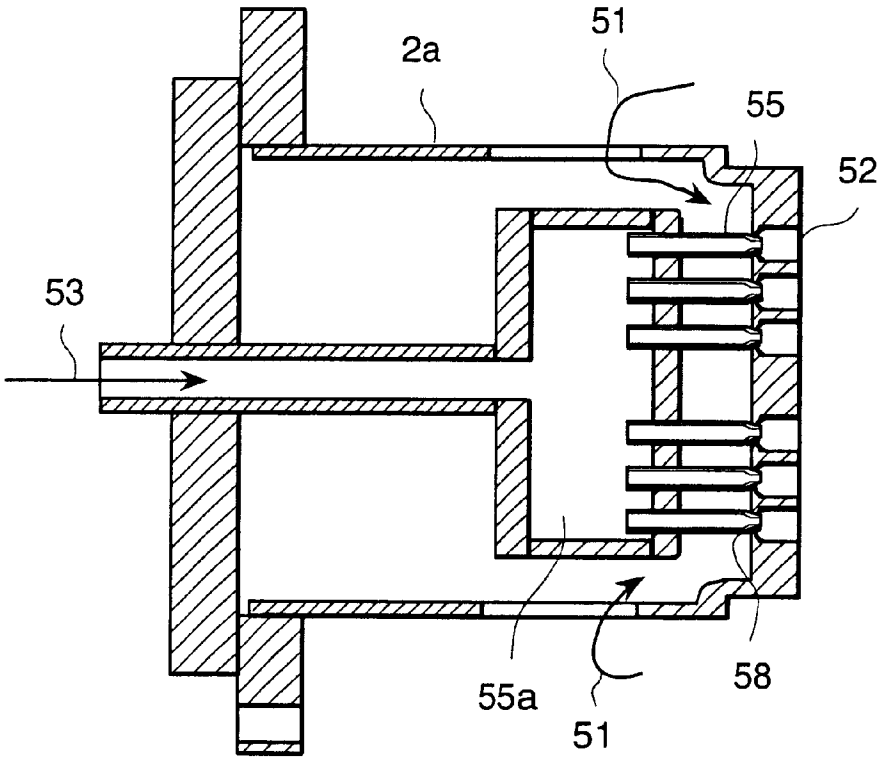

Fourth Embodiment FIGS. 7(*a*) and 7(*b*) show a fourth embodiment. This embodiment is basically the same as a second embodiment, however, the difference is that a swirling component is given to a coaxial jet itself by an air swirler 58.

This arrangement promotes mixture of each coaxial jet, which makes more uniform low NOx combustion possible. The structure of the fuel nozzle which gives a swirling component to a fuel jet can also promote mixture.

Fifth Embodiment

Figure 8:
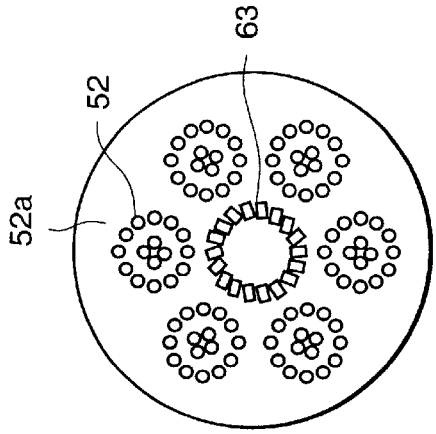
FIG. 8(*a*) is a sectional view, for detailed explanation, of a nozzle portion of a fifth embodiment according to the present invention.
Figure 8:
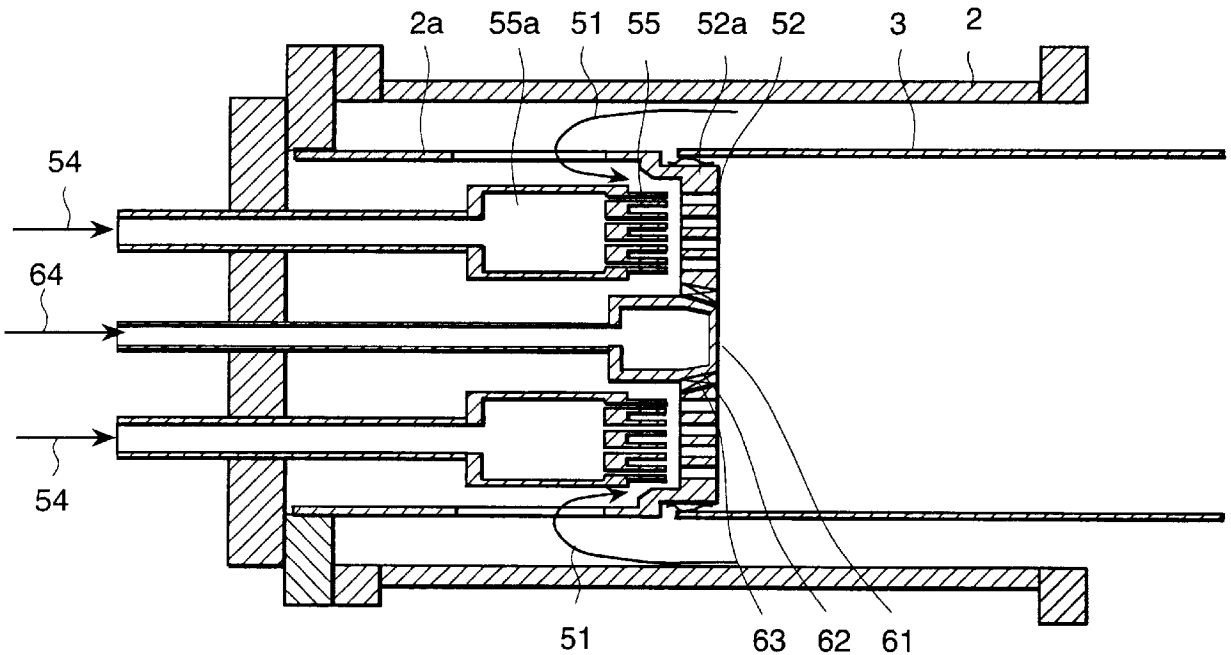

FIGS. 8(*a*) and 8(*b*) show a fifth embodiment. The difference of this embodiment is that the nozzle mounted to the central axis of a third embodiment is replaced with a conventional diffusing burner 61 which comprises air swirlers 63 and fuel nozzle holes 62 which intersect with the swirlers, respectively.

By using a conventional diffusing combustion burner for startup, increasing velocity, and partial loading in this arrangement, it is considered that this embodiment is advantageous when the starting stability is a major subject.

Sixth Embodiment

Figure 9:
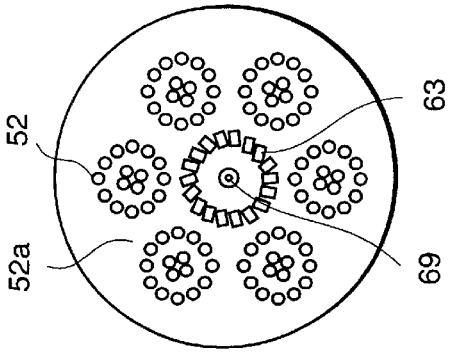
FIG. 9(*a*) is a sectional view, for detailed explanation, of a nozzle portion of a sixth embodiment according to the present invention.
Figure 9:
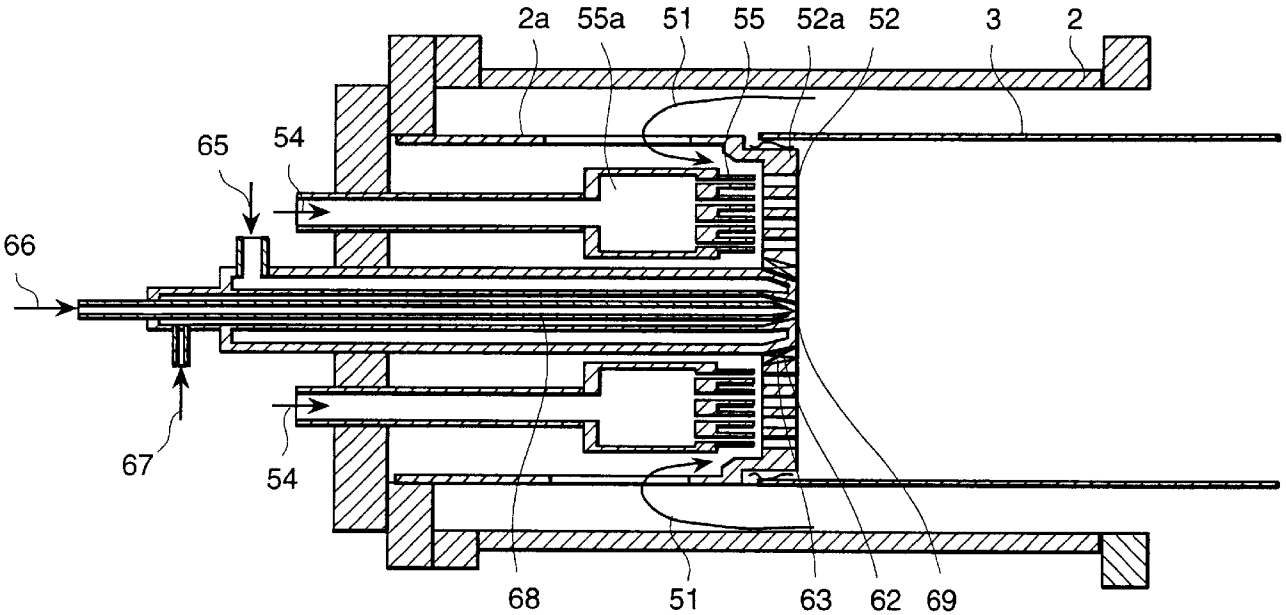

FIGS. 9(*a*) and 9(*b*) show a sixth embodiment. This embodiment has a liquid fuel nozzle 68 and a spray air nozzle 69 in the diffusing burner 61 according to the embodiment shown in FIGS. 8(*a*) and 8(*b*) so that liquid fuel 66 can be atomized by spray air 65 thereby handling liquid fuel combustion. Fuel 67 is supplied to the liquid fuel nozzle 68. Although, from the aspect of low level NOx emission, not much can be expected from this embodiment, this embodiment provides a combustor that can flexibly operate depending on the fuel supply condition.

Seventh Embodiment

Figure 10:
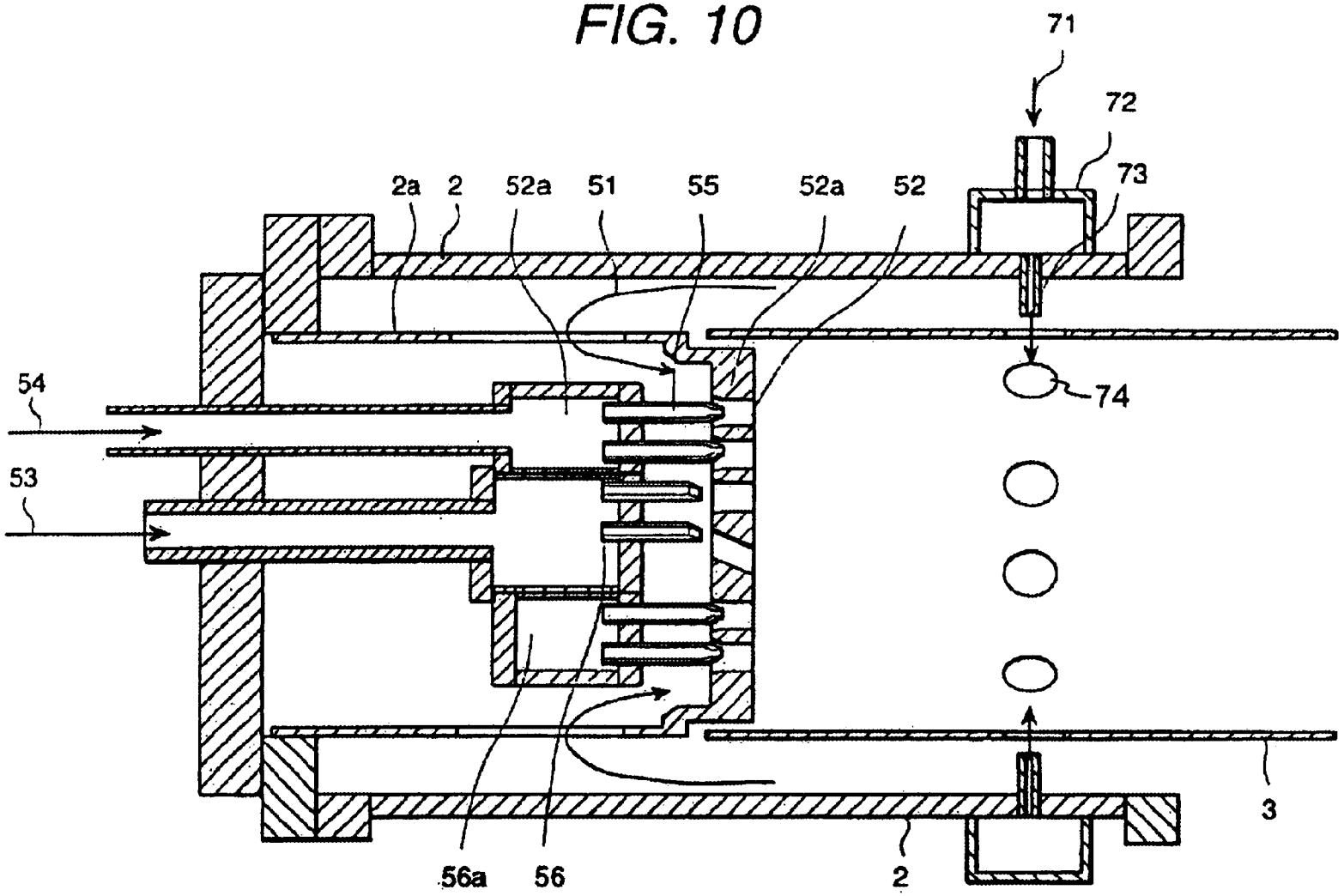
FIG. 10 is a sectional view, for detailed explanation, of a nozzle portion of a seventh embodiment according to the present invention.

FIG. 10 shows a seventh embodiment. This embodiment provides an auxiliary fuel supply system 71, a header 72, and a nozzle 73 on the downstream side of the combustor in addition to a first embodiment shown in FIG. 1 and FIGS. 4(*a*) and 4(*b*). Fuel injected from a nozzle 73 flows into a combustion chamber as a coaxial jet through an air hole 74, and combustion reaction is promoted by a high-temperature gas flowing out of the upstream side.

Although such an arrangement makes the structure complicated, it is possible to provide a low NOx combustor which can more flexibly respond to the load.

Eighth Embodiment

Figure 11:
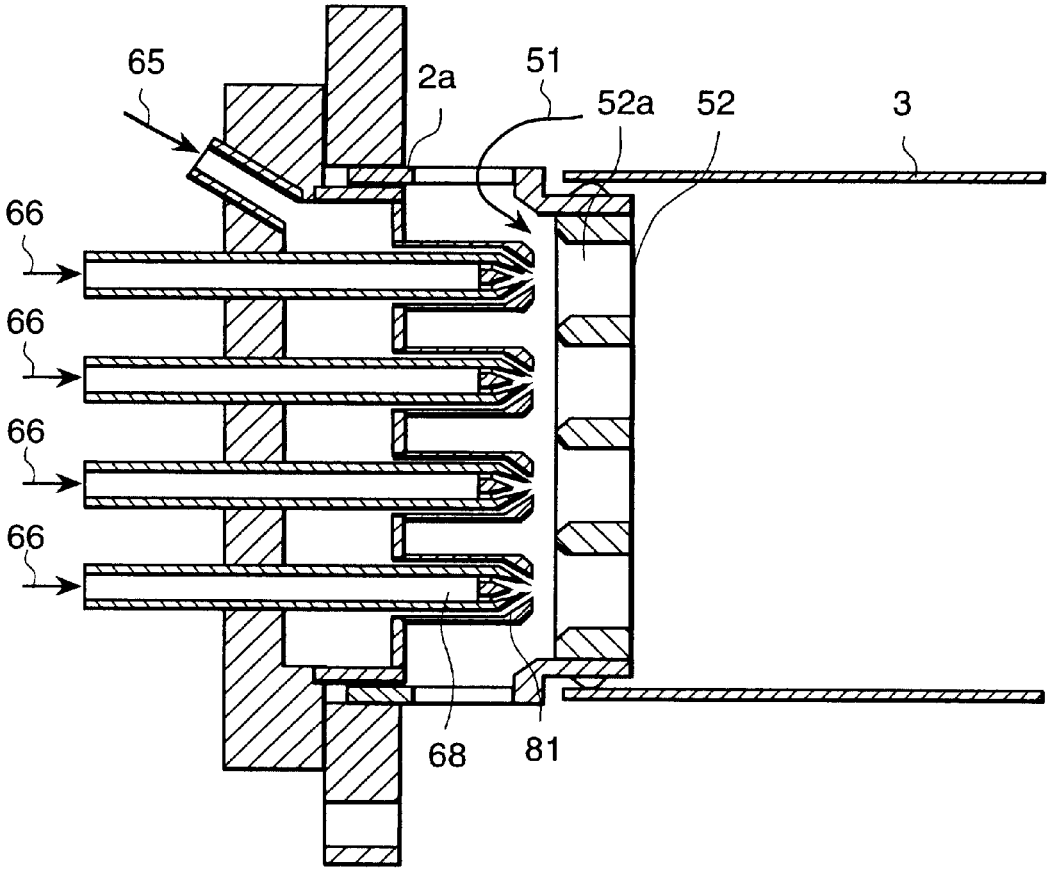
FIG. 11 is a sectional view, for detailed explanation, of a nozzle portion of an eighth embodiment according to the present invention.

FIG. 11 shows an eighth embodiment. In this embodiment, each fuel nozzle of the embodiment shown in FIGS. 9(*a*) and 9(*b*) is made double structured so that liquid fuel 66 is supplied to an inner liquid-fuel nozzle 68 and spray air 65 is supplied to an outer nozzle 81. This arrangement allows a large number of coaxial jets to be formed when liquid fuel 66 is used, thereby realizing low NOx combustion where there is very little potential of flash back.

Furthermore, it can also function as a low NOx combustor for gaseous fuel by stopping the supply of liquid fuel and supplying gaseous fuel instead of spray air. Thus, it is capable of providing a combustor that can handle both liquid and gaseous fuel.

As described above, by making a part of or all of the fuel nozzles double structured so that spraying of liquid fuel and gaseous fuel can be switched or combined, it is possible to handle both liquid and gaseous fuel.

Thus, according to the above-mentioned embodiment, by arranging a large number of coaxial jets in which the air flow envelopes the fuel, the fuel flows into the combustion chamber, mixes with an ambient coaxial air flow to become a premixed air fuel mixture having a proper stoichiometric mixture ratio, and then comes in contact with a high-temperature gas and starts to burn. Accordingly, low NOx combustion equivalent to lean premixed combustion is possible. At this time, the section which corresponds to a premixing tube of a conventional premixing combustor is extremely short, and the fuel concentration becomes almost zero in the vicinity of the wall surface, which keeps the potential of burnout caused by flash back very low.

This embodiment can provide a gas turbine combustor having low level NOx emission and good combustion stability and an operating method thereof.

What is claimed is:

1. A gas turbine combustor comprising:

a combustion chamber;

a member arranged at a upstream side of said combustion chamber and having a plurality of air holes formed therein, said air holes having inlets and outlets, respectively, said outlets of said air holes being dispersed in a direction transverse to an axis of said combustion chamber and opened to said combustion chamber;

a plurality of fuel nozzles for injecting fuel into said combustion chamber through said air holes, respectively; and wherein said air holes and said plurality of fuel nozzles are arranged so that fuel and air are jetted as a plurality of coaxial jet flows from said outlets of air holes into said combustion chamber; and wherein fuel holes of the fuel nozzles are disposed coaxially or almost coaxially with said air holes, respectively, and said fuel nozzles and said air holes are arranged so that a fuel jet from each of said fuel nozzles is injected toward the vicinity of the center of said inlet of each of said air holes, and a fuel jet and a circular flow of the air enveloping the fuel jet is injected into the combustion chamber as a coaxial jet from each of said air hole outlets.

2. A gas turbine combustor according to claim 1, wherein said plurality of fuel nozzles are partitioned into a plurality of fuel supply systems and a control system is provided so as to individually control the flow rate of fuel for each fuel supply system according to a load on the gas turbine.

3. A gas turbine combustor according to claim 2, wherein, a swirling angle which provides a swirling component around the axis of the combustor chamber is given to a part or all of said plurality of fuel nozzles and corresponding air holes.

4. A gas turbine combustor according to claim 2, wherein a fuel hole of the fuel nozzle is disposed coaxially or almost coaxially with the air hole, a fuel jet being injected toward the vicinity of the center of the air hole inlet, and a fuel jet and a circular flow of the air enveloping the fuel jet being injected into the combustion chamber as a coaxial jet from an outlet of the air hole, and a plurality of modules, each module consisting of the fuel nozzle and the air hole, are combined to form a combustor.

5. A gas turbine combustor according to claim 1, wherein said plurality of fuel nozzles are partitioned in a plurality of fuel supply systems, and a control system is provided for controlling independently a fuel flow rate in each of said plurality of fuel supply systems according to a load on the gas turbine.

6. A gas turbine combustor comprising:

a combustion chamber;

a member having a plurality of air holes formed therein, said air holes each opened to said combustion chamber;

a plurality of fuel nozzles corresponding to said air holes, and having fuel jet holes arranged coaxially or nearly coaxially with said air holes, respectively;

wherein said plurality of fuel nozzles and said air holes are arranged so that fuel jet flows from said fuel nozzles are directed to central portions of inlets of said air holes to form fuel jet flows enclosed by annular air flows which are jetted from outlets of said air holes as a plurality of coaxial jet flows into said combustion chamber; and a swirling means provided in at least a part of said plurality of fuel nozzles and the corresponding air holes, for imparting swirling components to the jet flows swirling around an axis of said combustion chamber.

7. A method of operating a gas turbine combustor having a plurality of fuel nozzles, air holes and a combustion chamber, said method comprising the steps of:

arranging fuel jet holes of said fuel nozzles to be coaxial or nearly coaxial with said air holes;

flowing air into said combustion chamber through said air holes;

jetting fuel from said fuel nozzles to central portions of inlets of said air holes so that fuel jet flows from said fuel nozzles and annular air flows enclosing said fuel jet flows are jetted from an outlet of said air holes into said combustion chamber as a plurality of coaxial jet flows; and imparting swirling components swirling around an axis of said combustion chamber to jet flows from at least part of said plurality of fuel nozzles and the corresponding air holes.

* * * * *